US009072962B1

(12) United States Patent
Grist et al.

(10) Patent No.: US 9,072,962 B1
(45) Date of Patent: Jul. 7, 2015

(54) PORTABLE GAME DEVICES HAVING PRIZE COMPARTMENTS AND LOCK MECHANISMS

(71) Applicants: Elizabeth A. Grist, Baltimore, MD (US); Ryan Singh, Loxahatchee, FL (US)

(72) Inventors: Elizabeth A. Grist, Baltimore, MD (US); Ryan Singh, Loxahatchee, FL (US)

(73) Assignee: T.E. Brangs, Inc., Baltimore, MD (US)

( * ) Notice: Subject to any disclaimer, the term of this patent is extended or adjusted under 35 U.S.C. 154(b) by 0 days.

(21) Appl. No.: 13/735,420

(22) Filed: Jan. 7, 2013

(51) Int. Cl.
*A63F 7/04* (2006.01)

(52) U.S. Cl.
CPC ..... *A63F 7/04* (2013.01)

(58) Field of Classification Search
USPC ..... 273/119
See application file for complete search history.

(56) References Cited

U.S. PATENT DOCUMENTS 1,942,932 A * 1/1934 Nicholas ..... 273/145 CA
2,126,245 A * 8/1938 Darby ..... 473/589
2,308,263 A 1/1943 Bengner
3,119,619 A * 1/1964 Frank ..... 273/336
3,201,128 A * 8/1965 Palovik ..... 473/572
3,452,987 A * 7/1969 Di Motta ..... 273/110
3,582,074 A * 6/1971 Menotti ..... 273/121 A
3,596,911 A * 8/1971 Kessler ..... 273/123 R
3,679,170 A * 7/1972 Bernas et al. ..... 251/104
3,679,211 A * 7/1972 Hartley ..... 273/144 B
3,690,664 A * 9/1972 Hauke et al. ..... 273/127 D
3,975,019 A * 8/1976 Barlow ..... 273/121 A
4,103,894 A * 8/1978 McCraw ..... 273/126 A
4,105,207 A * 8/1978 Cooper et al. ..... 273/108.32
4,203,592 A * 5/1980 Quatkemeyer ..... 273/336
4,204,682 A * 5/1980 Brown ..... 273/401
4,224,575 A * 9/1980 Mosley et al. ..... 331/23
4,239,220 A 12/1980 Kurita
4,239,222 A 12/1980 Hori
4,244,572 A * 1/1981 Hatakeyama ..... 273/120 R
4,244,575 A 1/1981 Hori
4,269,413 A * 5/1981 Langieri ..... 273/121 R
D264,855 S * 6/1982 Ohkado ..... D21/323
4,361,327 A 11/1982 Kurita et al.
4,480,497 A * 11/1984 Locher ..... 74/531
4,504,057 A 3/1985 Wiczer
4,805,906 A * 2/1989 Wiczer et al. ..... 273/119 A
5,088,736 A 2/1992 Chuang
5,100,151 A * 3/1992 Lyon et al. ..... 273/285
5,104,130 A * 4/1992 Francin ..... 273/348
5,110,139 A * 5/1992 Baumgartner ..... 273/400
5,121,919 A 6/1992 Martti
5,125,669 A * 6/1992 Kanda ..... 273/348
5,149,093 A 9/1992 Schilling et al.

(Continued)

*Primary Examiner* — Michael Dennis
*Assistant Examiner* — Dolores Collins
(74) *Attorney, Agent, or Firm* — Garret IP, L.L.C.

(57) ABSTRACT

A portable game device having a game ball passage, which may include a labyrinth and/or maze. A mechanical actuator may have a ball cavity to retain a ball when in a rest position and to release the ball into the game ball passage when in a first position. The device may include a prize compartment, a movable cover to enclose a first opening to the prize compartment, and a lock mechanism to releasably retain the cover in a closed position. The actuator may be controllable to unlock the cover with the ball. The device may include one or more ramped, angled, concave, and/or channeled surfaces to guide the ball as the actuator moves the ball. A second, uncovered opening to the prize compartment may be provided to insert a prize without unlocking the cover. The second opening may include feature(s) to inhibit removal of the prize through the uncovered opening.

19 Claims, 15 Drawing Sheets

(56) References Cited

U.S. PATENT DOCUMENTS

| | | | | | |
|---|---|---|---|---|---|
| 5,199,708 | A | * | 4/1993 | Lucas | 273/126 R |
| D337,790 | S | * | 7/1993 | Gottlieb et al. | D21/323 |
| 5,310,184 | A | | 5/1994 | Grist | |
| 5,405,142 | A | | 4/1995 | Arad et al. | |
| 5,413,352 | A | * | 5/1995 | Persidsky et al. | 273/287 |
| 5,415,401 | A | | 5/1995 | Nagasaka | |
| 5,509,656 | A | | 4/1996 | Berger et al. | |
| 5,536,007 | A | * | 7/1996 | Snyder | 273/118 R |
| 5,611,541 | A | * | 3/1997 | Paino | 273/317 |
| 5,639,087 | A | * | 6/1997 | Ogawa et al. | 273/109 |
| 5,664,779 | A | | 9/1997 | Soovajian, Jr. | |
| 5,730,441 | A | | 3/1998 | Gibbons et al. | |
| 5,769,418 | A | | 6/1998 | Gilbert et al. | |
| 5,816,918 | A | * | 10/1998 | Kelly et al. | 463/16 |
| 5,961,116 | A | * | 10/1999 | Beyer | 273/119 R |
| 5,988,637 | A | | 11/1999 | Dickerson | |
| 6,015,151 | A | * | 1/2000 | Carovillano et al. | 273/317 |
| 6,022,020 | A | | 2/2000 | Nishikawa | |
| 6,152,645 | A | * | 11/2000 | Sanford | 403/328 |
| 6,467,363 | B2 | * | 10/2002 | Manzanares et al. | 74/89.39 |
| 6,497,407 | B2 | | 12/2002 | Humphrey | |
| 6,598,876 | B1 | | 7/2003 | Pierce et al. | |
| 6,779,794 | B2 | * | 8/2004 | Hedrick et al. | 273/148 R |
| 6,932,344 | B1 | * | 8/2005 | Soto | 273/400 |
| 7,070,506 | B1 | | 7/2006 | Ropp et al. | |
| 7,118,105 | B2 | | 10/2006 | Benevento | |
| 7,264,155 | B2 | | 9/2007 | Halbur et al. | |
| 7,281,976 | B2 | | 10/2007 | Okada et al. | |
| 7,946,585 | B2 | | 5/2011 | Grist et al. | |
| 8,011,660 | B1 | * | 9/2011 | Butler | 273/126 R |
| 8,148,670 | B2 | * | 4/2012 | Tong et al. | 244/3.27 |
| 8,434,763 | B2 | * | 5/2013 | Butler | 273/126 R |
| 8,814,137 | B2 | * | 8/2014 | Wong | 251/149.9 |
| 2009/0085286 | A1 | | 4/2009 | Grist et al. | |
| 2013/0075972 | A1 | * | 3/2013 | Payer | 273/317 |

* cited by examiner (View B)

(View A)

PORTABLE GAME DEVICES HAVING PRIZE COMPARTMENTS AND LOCK MECHANISMS

BACKGROUND

Ball-based game devices are typically relatively large, electrically operated, mechanically complex, and expensive to manufacture.

SUMMARY

Disclosed herein are portable game devices having a ball passage therein configured as a labyrinth or maze.

A portable game device, as disclosed herein, may further include a gift or prize compartment therein, a movable cover to enclose an opening to the prize compartment, a lock mechanism to releasably lock the cover in place, and an actuator to unlock the cover to expose the opening to the prize compartment upon completion of the labyrinth or maze.

Figure 1:
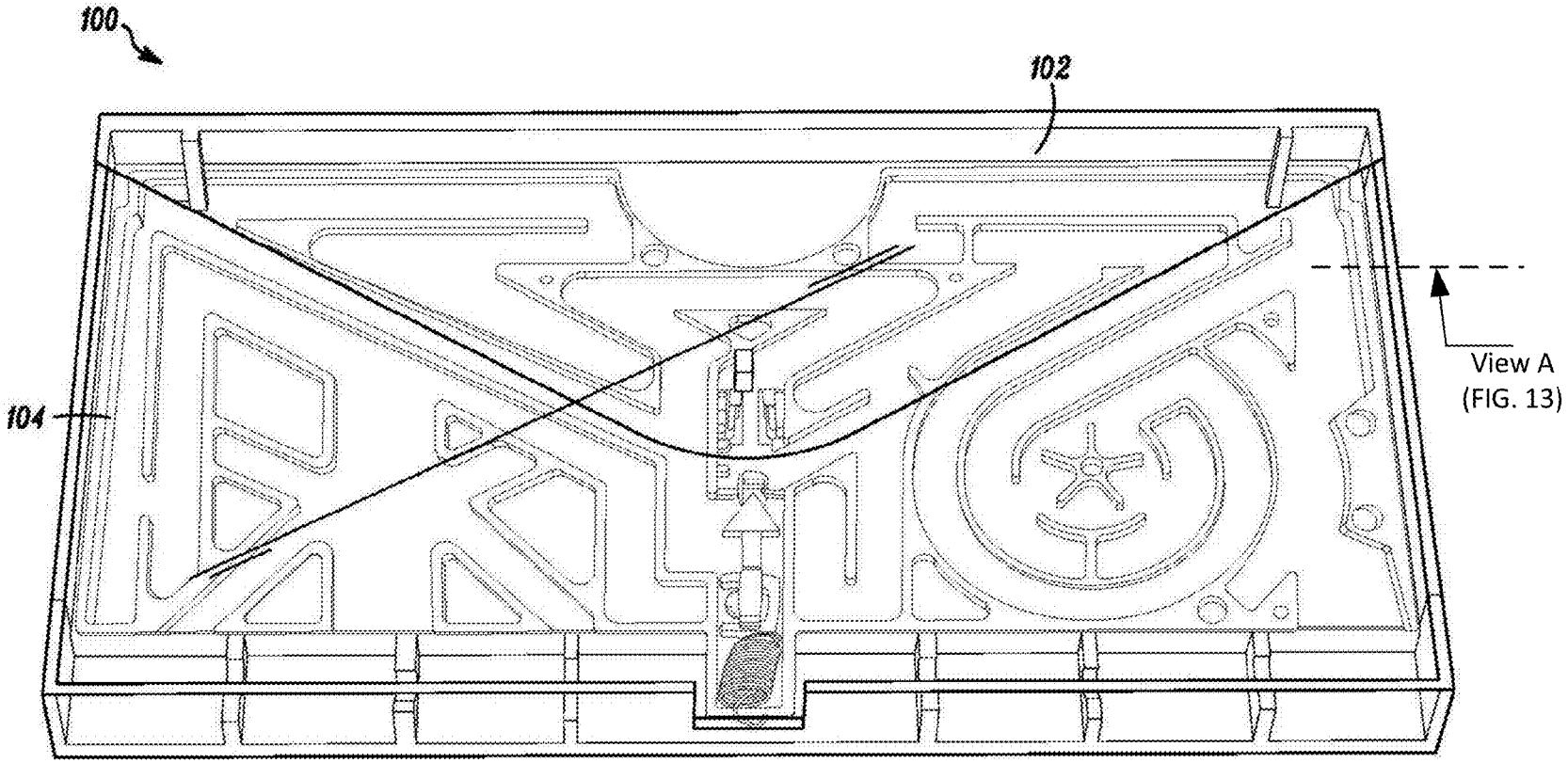
FIG. 1 is a perspective view of a game device from a first viewpoint that faces a first side of the game device, where the game device includes a housing and a cover.

In the drawings, the leftmost digit(s) of a reference number identifies the drawing in which the reference number first appears.

DETAILED DESCRIPTION

FIG. 1 is a perspective view of a device 100 from a first viewpoint directed toward a first side of device 100.

Device 100 includes a housing 104 having a passage therein to permit a ball to travel from a first area within the housing to a second area within the housing when housing 104 is subjected to a sequence of tilting motions. The passage is also referred to herein as a ball passage and a game ball passage. The ball passage may be configured as a labyrinth, including turns or twists along the passage. Alternatively, or additionally, the ball passage may be configured as a maze that includes one or more branch passages, each having a first end that opens to the passage and a second that that terminates as a dead-end, also referred to herein as a terminal end.

Housing 104 includes one or more passive and/or dynamic obstacles with the ball passage and/or within a branch channel. A passive obstacle may include a wall having an opening therethrough to provide a relatively constricted passage for the ball. A dynamic obstacle may include a rotatable pinwheel or paddle-wheel device, such as described in one or more examples below.

Housing 104 may have a first cavity therein and one or more walls extending from one or more surfaces of the first cavity to define the ball passage.

Housing 104 may have a second cavity therein, also referred to herein as a gift or prize compartment, to hold a prize or gift. The prize compartment may be dimensioned to hold a relatively thin prize, such as paper currency or a financial transaction card, such as a gift card having credit make purchases from a retail store or restaurant, or from an on-line retailer. The prize compartment and prizes or gifts are not, however, limited to these examples.

Housing 104 may include one or more openings through a surface(s) thereof to permit insertion and/or retrieval of the prize to and from the prize compartment.

In an embodiment, housing 104 includes a first opening to permit retrieval of the prize from the prize compartment upon completion of the game (e.g., moving the ball from the first area to the second area). Where the prize compartment is dimensioned to hold a relatively thin prize, the first opening may be in the form of a slot.

In FIG. 1, device 100 includes a cover 102 to enclose the first opening to the prize compartment when in a first or closed position, and to expose the first opening when in a second or open position. When in the closed position, cover 102 precludes removal of a prize from the prize compartment through the first opening. When in the open position, cover 102 expose the first opening to permit removal of the prize from the prize compartment.

In FIG. 1, cover 102 is illustrated in the closed position, also referred to herein as a closed position.

Cover 102 may be hingedly connected to housing 104 to open away from the first side of device 100, such as described in one or more examples below.

Housing 104 may include a second opening to the prize compartment to permit insertion of a gift or prize into the prize compartment without opening cover 102. Housing 104 may be further configured to preclude or inhibit removal of the prize from the prize compartment through the second opening. Where the prize compartment is dimensioned to hold a relatively thin prize, the second opening may be in the form of a slot. An example implementation of the second opening is disclosed further below with reference to FIG. 13.

Figure 2:
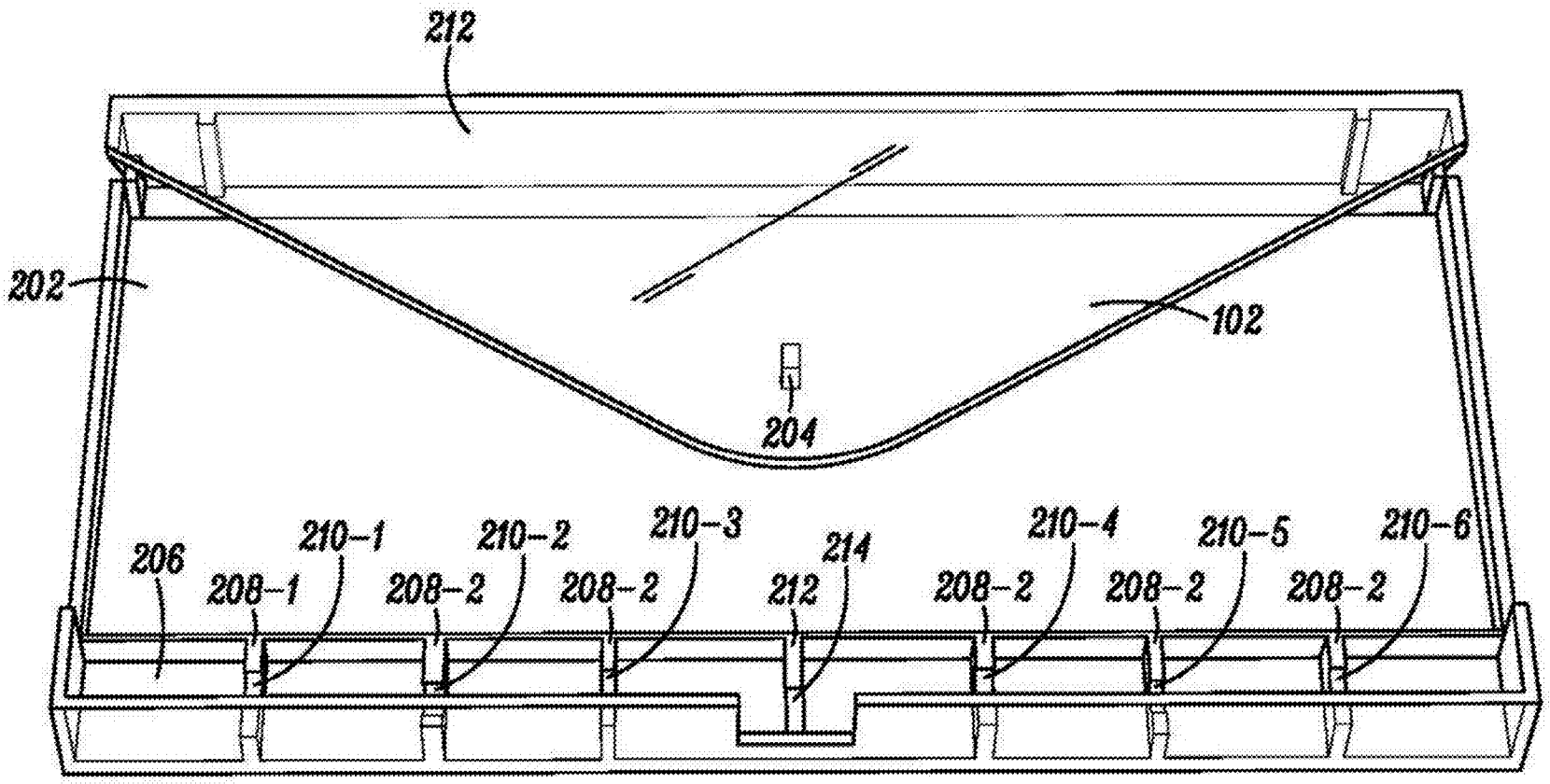
FIG. 2 is a perspective view from the first viewpoint of the cover and a base of the housing.

FIG. 2 is a perspective view of cover 102, from the first viewpoint, where cover 102 is hingedly connected to a base 202 of housing 104. In FIG. 2, cover 102 is illustrated in the closed position.

Cover 102 includes an enclosure portion 212 to enclose the first opening to the prize compartment when cover 102 is in the closed position.

Cover 102 may include a protrusion 204 to lockingly engage with a lock mechanism to releasably lock cover 102 in the closed position.

An inner surface of base 202, facing cover 102, may serve as cavity wall of a prize compartment.

Figure 3:
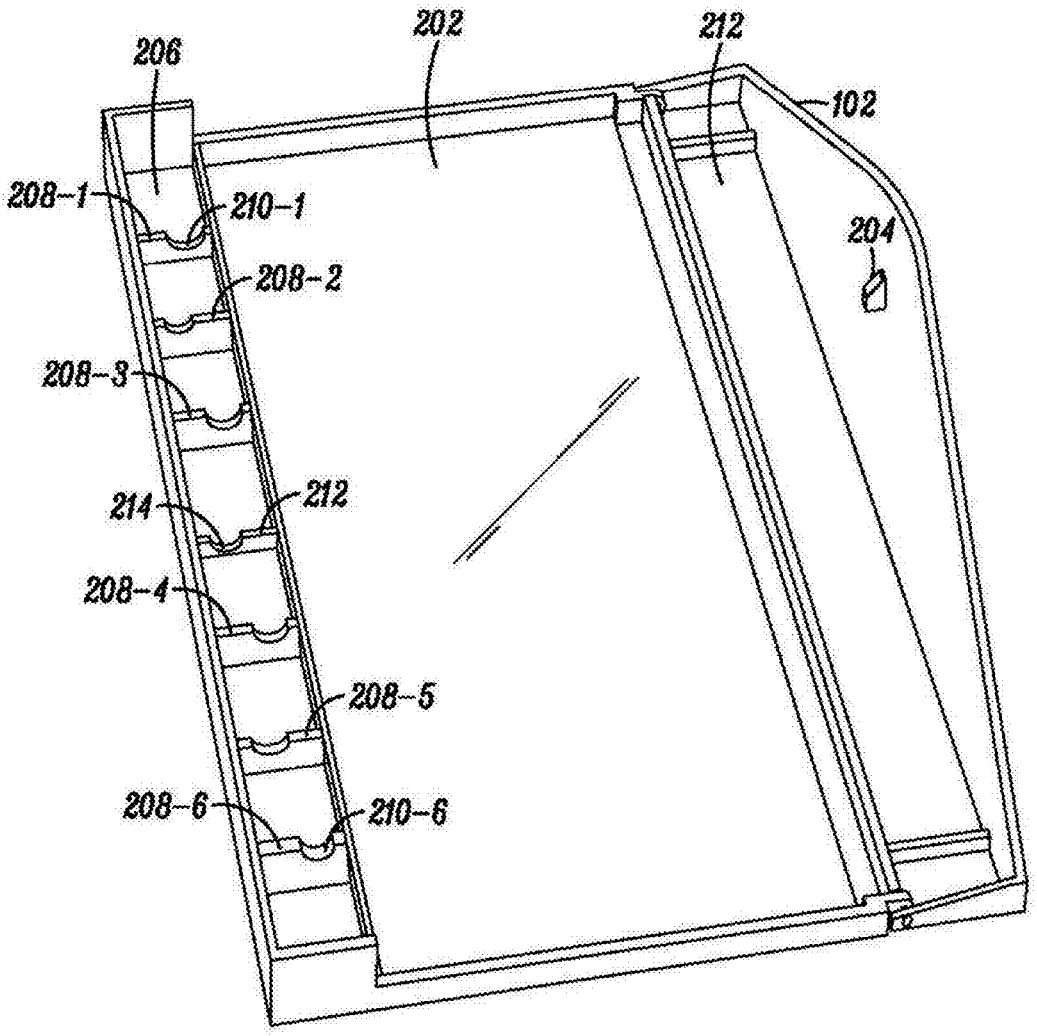
FIG. 3 is a perspective view of the cover and the base from another viewpoint.

FIG. 3 is a perspective view of cover 102 and base 202 from another viewpoint. In FIG. 3, cover 102 is illustrated in a second position, also referred to herein as an open position.

Figure 4:
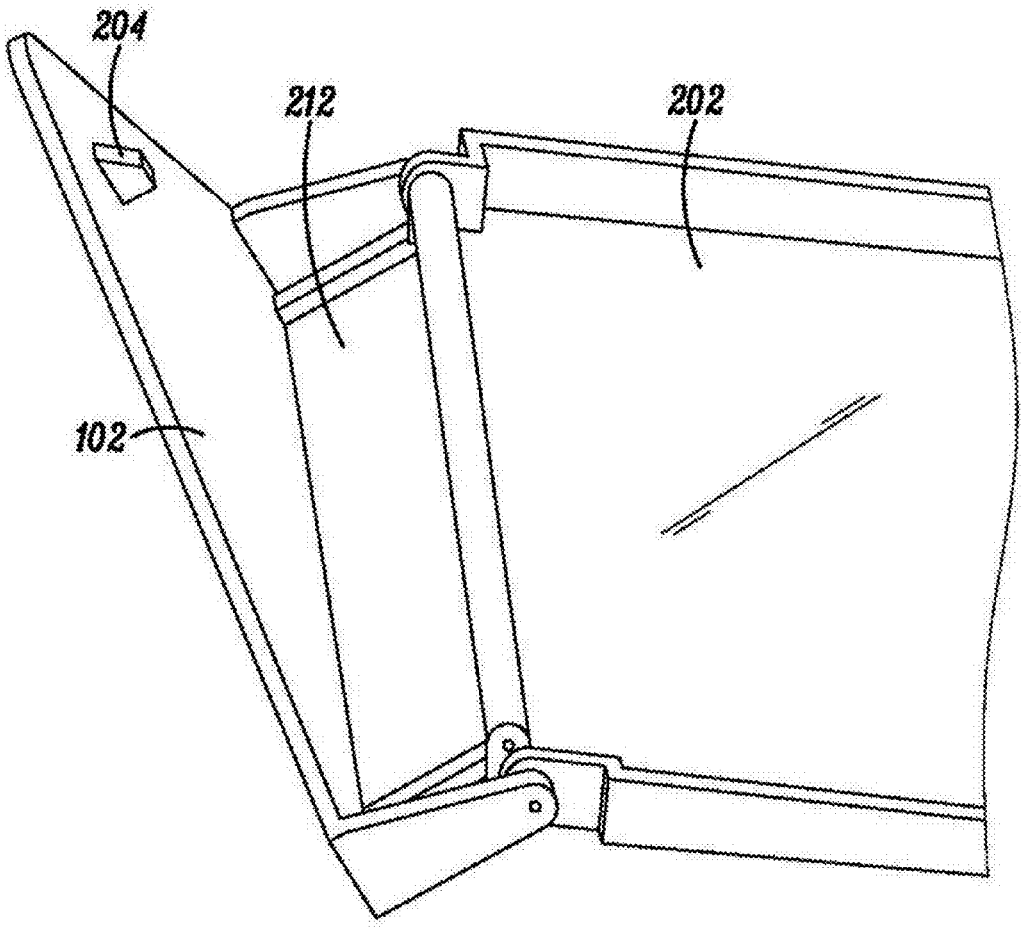
FIG. 4 is a perspective view of the cover and the base from another viewpoint.

FIG. 4 is a perspective view of cover 102 and base 202 from another viewpoint. In FIG. 4, cover 102 is illustrated in the open position.

Figure 5:
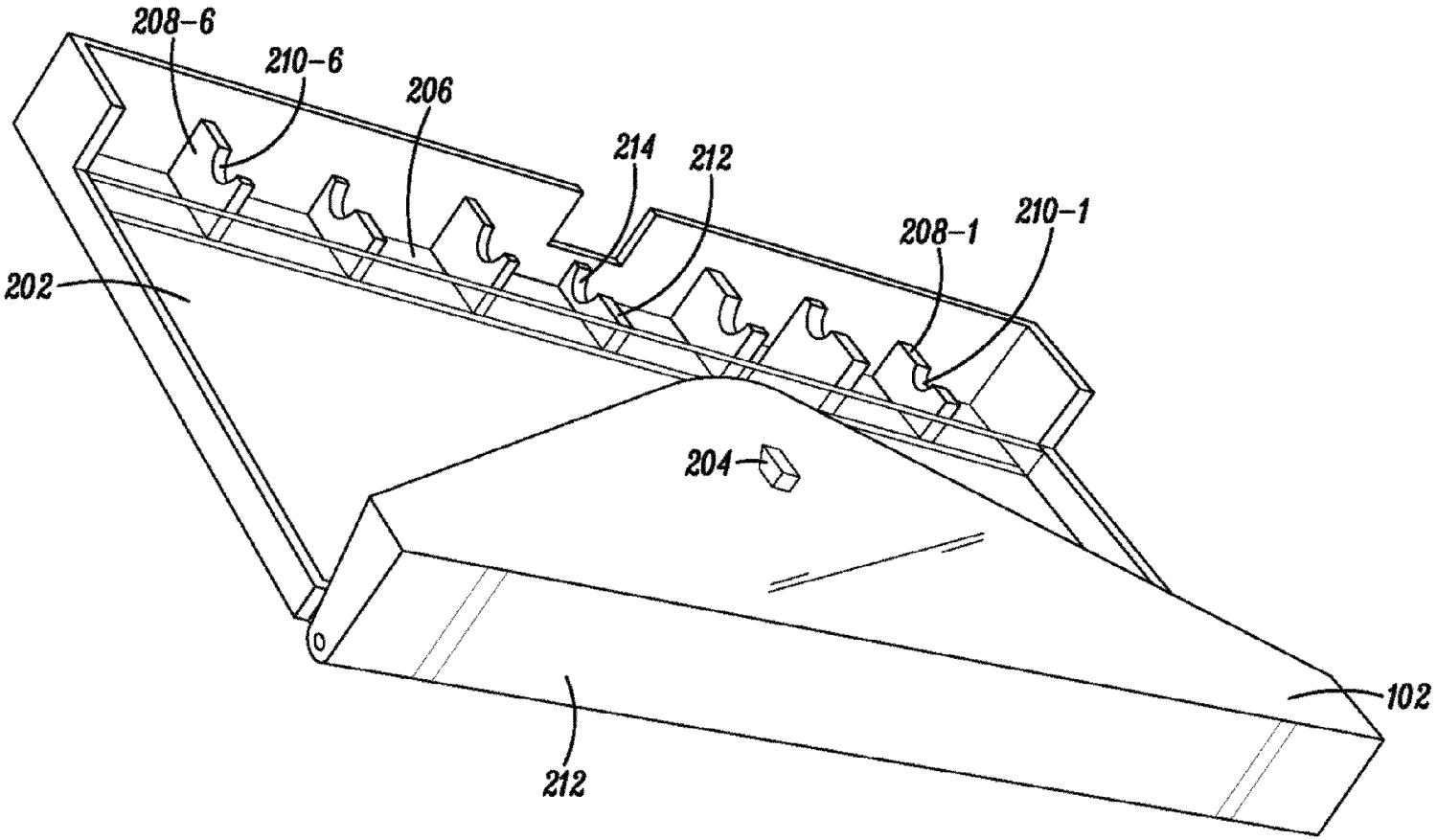
FIG. 5 is a perspective view of the cover and the base from another viewpoint.

FIG. 5 is a perspective view of cover 102 and base 202 from another viewpoint. In FIG. 5, cover 102 is illustrated in the closed position.

Example embodiments and features of a labyrinth or maze ball passage are now described.

In FIG. 2, base 202 includes a wall extending from an inner surface thereof to define or provide a channel 206. Base 202 further includes a set of wall portions 208 and a wall portion 212, extending from the surface of base 202 within channel 206.

Each of wall portions 208 includes a corresponding cutout 210, and wall portion 212 includes a cutout 214. The cutouts may be substantially semi-circular.

In the example of FIG. 2, wall portions 208 are substantially parallel with one another and with wall portion 212. Device 100 is not, however, limited to this example. Channel 206 and the wall portions therein are described further below with reference to FIGS. 6 and 8.

Figure 6:
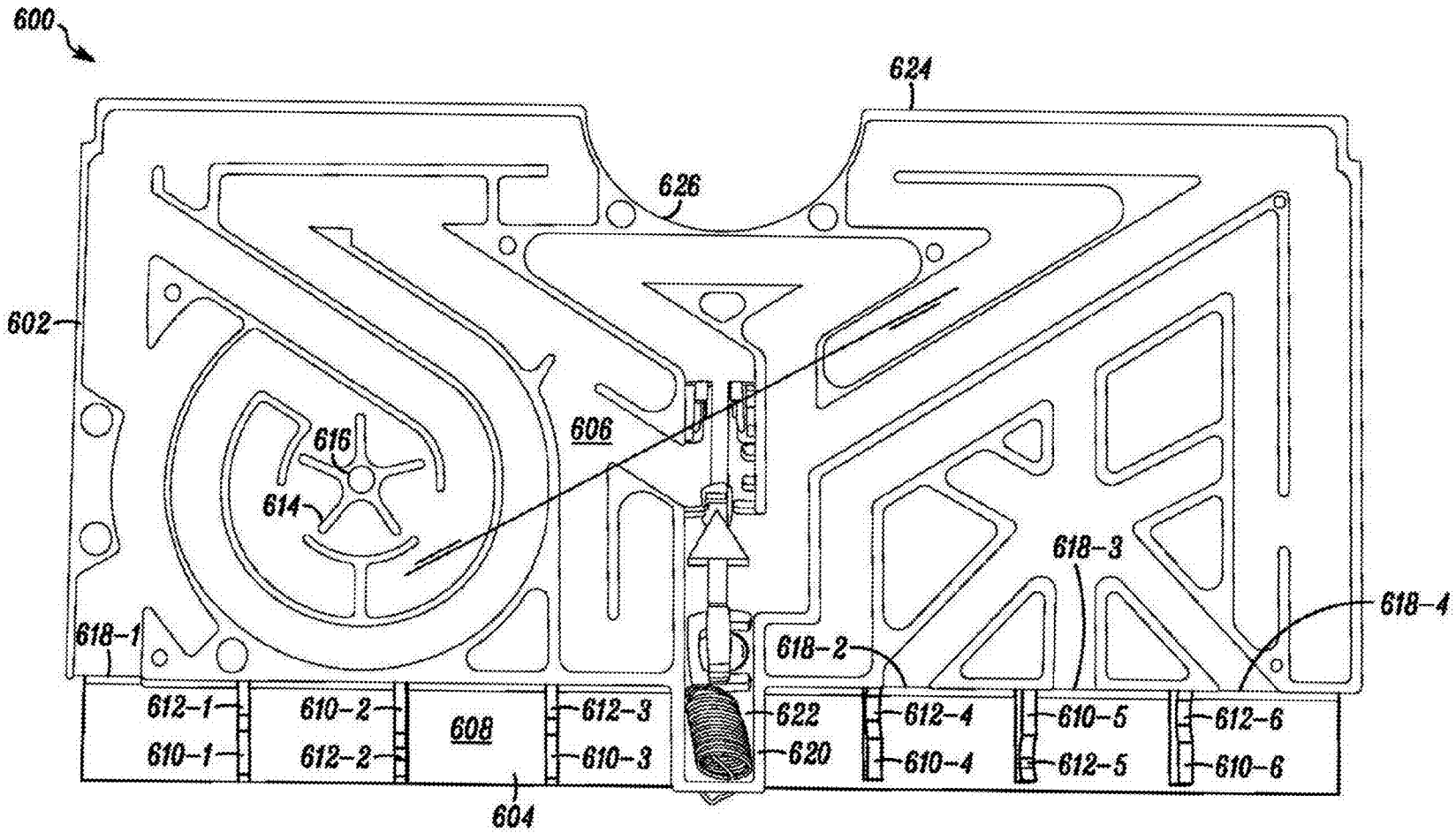
FIG. 6 is a perspective view of an assembly of the housing, viewed from a second viewpoint opposite the first viewpoint of FIGS. 1 and 2, where the assembly has a ball passage therein, and where the assembly includes first and second sub-assemblies.

FIG. 6 is a perspective view of an assembly 600, viewed from a second viewpoint opposite the first viewpoint of FIGS. 1 and 2. Assembly 600 is dimensioned to fit between cover 102 and base 202. For example, assembly 600 as illustrated in FIG. 6 may be flipped over and placed between cover 102 and base 202 illustrated in FIG. 2.

A cavity between a surface 606 of assembly 600 and base 202 provides the prize compartment described above with reference to FIG. 2. An opening to the prize compartment may be provided between surface 606 base 202, along an upper edge 624 of assembly 600. Assembly 600 may include a cutout 626 to permit grasping of the prize when cover 102 is in the open position.

Assembly 600 may have a cavity therein and walls extending from surfaces thereof to form at least a portion of the passage described above.

Assembly 600 may further include one or more passive and/or dynamic obstacles within the passage to block, confine, restrict, and/or re-direct the ball.

In the example of FIG. 6, assembly 600 includes a dynamic obstacle 614, illustrated here as a rotatable ball re-director, also referred to interchangeably herein as a paddle-wheel and a wind-mill. Dynamic obstacle 614 may rotate about an axle 616 in response to force applied by the ball.

Assembly 600 may be manufactured or fabricated as a unitary device or may include multiple components or sub-assemblies. In the example of FIG. 6, assembly 600 includes a first sub-assembly 602 having a first side or surface 606, and a second sub-assembly 604 having a first side or surface 608.

Sub-assembly 602 is described below with reference to FIG. 7. Sub-assembly 604 is described below with reference to FIG. 8.

Figure 7:
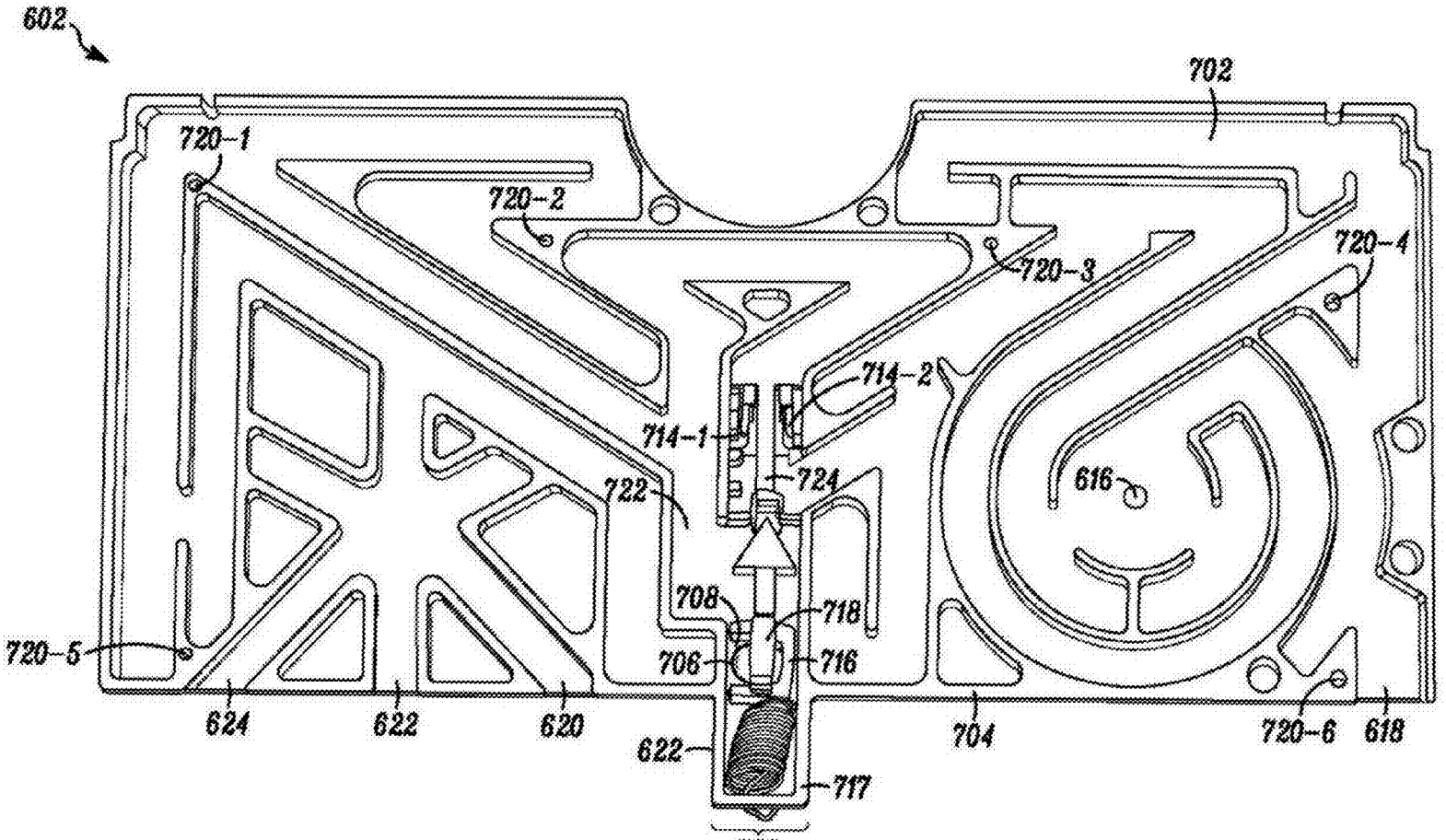
FIG. 7 is a view of the first sub-assembly.

FIG. 7 is a view of sub-assembly 602, directed toward a second side or surface 702 of sub-assembly 602, opposite first side 606 (FIG. 6).

Sub-assembly 602 includes walls extending outwardly from surface 702 to provide or define a channel of the ball passage. The ball passage may be configured to permit the ball to travel from a first area 722 to a second area 724.

Sub-assembly 602 further includes a lock mechanism to lockingly engage protrusion 204 of cover 102. In FIG. 7, the lock mechanism includes flexible detents 714 to releasably secure protrusion 204.

Sub-assembly 602 further includes an actuator 730 to unlock the lock mechanism. In the example of FIG. 7, actuator 730 includes a body 716 slideably positioned within a channel. The channel includes a channel portion within an extension 620 defined by a wall 717. Actuator 730 further includes a handle 718 that extends from body 716 to permit external control of actuator 730. Actuator 730 is described further below with reference to FIGS. 9 and 10.

Figure 8:
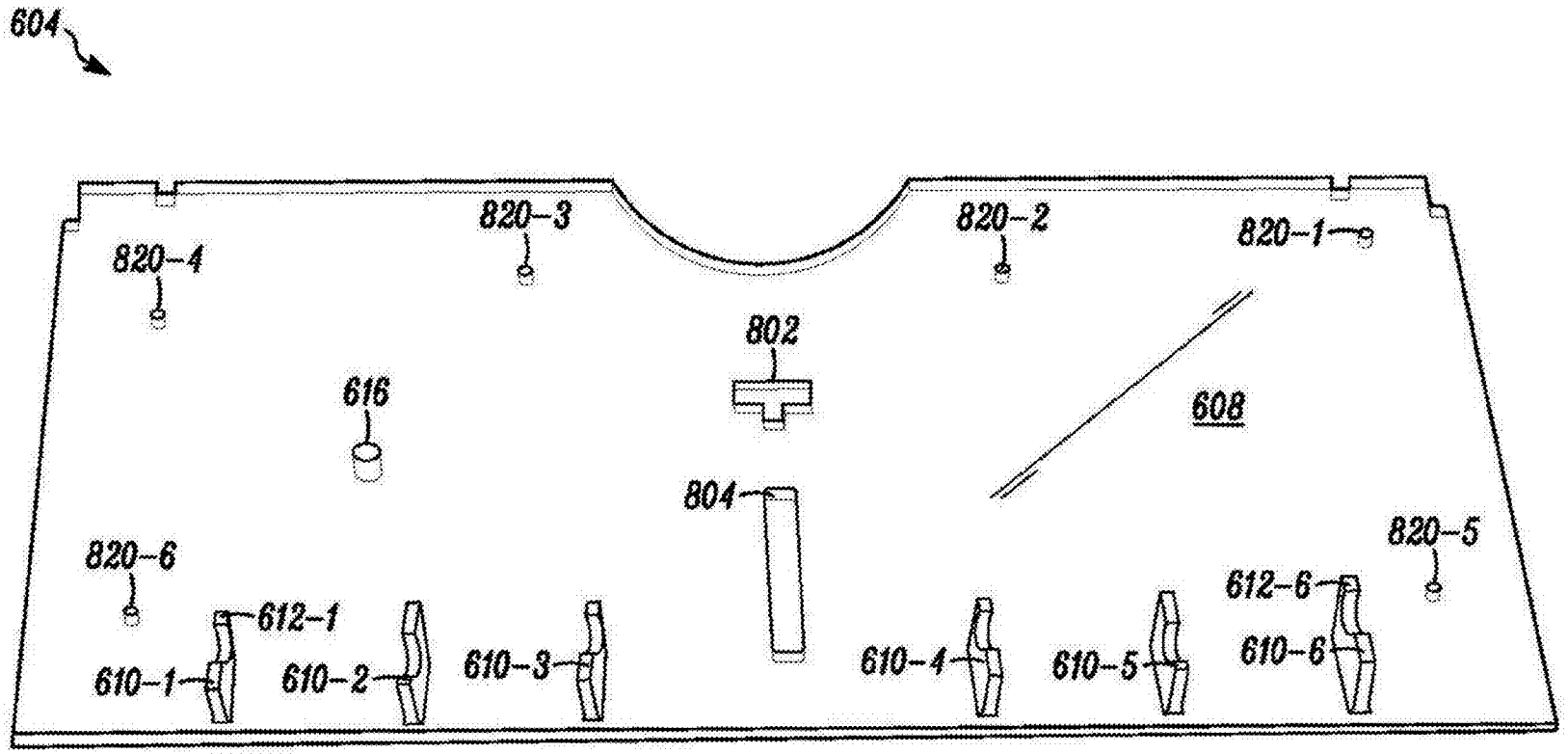
FIG. 8 is a view of the second sub-assembly.

FIG. 8 is a view of sub-assembly 604, directed toward first side 608 (FIG. 6).

Sub-assembly 602 as depicted in FIG. 7 may be flipped over and joined with second sub-assembly 604 as depicted in FIG. 8, so that surfaces 606 and 608 are as depicted in FIG. 6, where surfaces 606 and 608 face one another.

In the example of FIG. 8, sub-assembly 604 includes a first opening 802 through surface 608, having dimensions to permit protrusion 204 of cover 102 to pass therethrough to engage the lock mechanism of sub-assembly 602.

Sub-assembly 604 includes a second opening 804 through surface 608, having dimensions to permit handle 718 of actuator 730 (FIG. 7) to extend therethrough.

Sub-assembly 602 and/or sub-assembly 604 may include one or more features to join, engage, or mate with the other one of sub-assembly 602 and sub-assembly 604. In FIG. 8, sub-assembly 604 includes protrusions 820-1 through 820-6 extending outwardly from surface 608 to engage corresponding protrusions and/or recessed portions 720-1 through 720-6 of sub-assembly 602 in FIG. 7.

When device 100 is assembled, the actuator channel of FIG. 7 is enclosed by surface 608 of sub-assembly 604, and channel 206 (FIGS. 2, 3, and 5) is substantially enclosed by a portion of surface 608 and wall 704 (FIG. 7). In addition, in FIG. 7, a wall 704 has openings 618 through a surface thereof to permit the ball to travel between channel 206 and the channel of FIG. 7. In this example, the enclosed channel of FIG. 7 may be referred to as a first portion of the ball channel, and enclosed channel 206 may be referred to as a second portion of the ball channel.

In FIGS. 6 and 8, sub-assembly 604 includes a set of wall portions 610, each having a cutout 612. Wall portions 610 are dimensioned and positioned to join, engage, or mate with corresponding ones of opposing wall portions 208 (FIGS. 2, 3, and 5). Each pair of a wall portion 208 and an opposing wall portion 610 forms a wall within channel 206. A corresponding pair of cutouts 210 and 612 forms a relatively restricted opening through the wall, through which ball 706 may pass or travel. Positions of the restricted openings may vary from wall to the wall to provide a staggered passage of restricted openings through which ball 706 may travel.

Extension 620 (FIGS. 6 and 7) may serve as a static obstacle within channel 206, which may have a bypass opening. For example, in FIGS. 6 and 8, a surface of extension 620 has a recess 622 over a width of extension 620. In FIGS. 2, 3, and 5, wall portion 212 is positioned to meet with a surface of extension 620 to provide a static obstacle within channel 206. Further in FIG. 6, a surface of extension 620 has a recess 622 over a width of extension 620, opposite cutout 214 of wall portion 212, to provide a relatively restricted bypass opening through which ball 706 may bypass the static obstacle.

In FIG. 8, sub-assembly 604 has a second surface opposite first surface 608. In FIG. 1, the second surface of sub-assembly 604 faces outwardly from the page. Cover 102 is in contact with the second surface of sub-assembly 604 when cover 102 is the closed position of FIG. 1. The second surface of sub-assembly 604 may be configured to inhibit tampering with cover 102 when cover 102 is in the closed position of FIG. 1, such as described further below with reference to FIG. 14 and/or FIG. 15.

Figure 9:
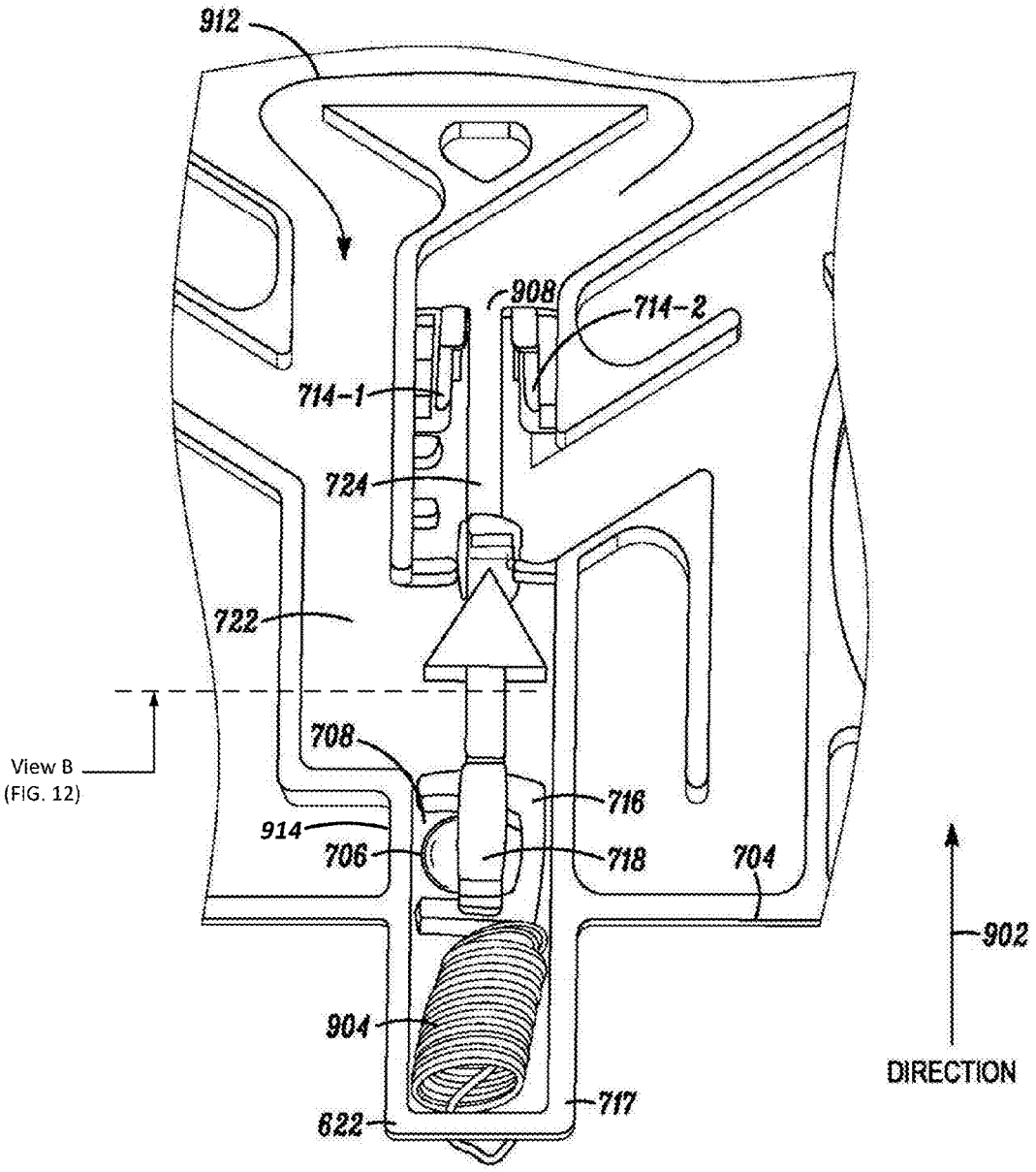
FIG. 9 is an expanded view of a portion of the first sub-assembly including an actuator, where a ball is in a first area of the ball passage.

FIG. 9 is an expanded view of a portion of sub-assembly 602, including a portion of actuator 730. In FIG. 9, actuator 730 is at a first position, also referred to herein as a rest position.

In FIG. 9, a surface of actuator body 716 has an opening therethrough to a ball cavity 708 therein. When actuator 730 is in the first position, the opening through the surface of body 716 faces an opposing wall 914. When ball 706 is within ball cavity 708, and actuator 730 is in the first position, opposing wall 914 retains or secures ball 706 within ball cavity 708.

Ball 706 may be secured within ball cavity 708 during manufacture, packaging, and/or shipping to provide device 100 to a purchaser in a ready-to-use mode. A purchaser or user may thus insert a prize through the second opening to the prize without having to first complete the labyrinth or maze. Similarly, after completion of the labyrinth or maze, a user may re-secure ball 706 within ball cavity 708, and re-insert a prize through the second opening.

When an eternal force is applied to handle 718 in a direction 902, actuator 730 moves in direction 902 from the first position toward a second position, also referred to herein as a first extended position. When actuator 730 is in the first extended position, the opening to ball cavity 708 faces a first area 722 to permit ball 706 to enter ball cavity 708 from first area 722, or exit ball cavity 708 and enter area 722.

Device 100 may include one or more features to assist in moving ball 706 from ball cavity 108 into first area 722, examples of which are disclosed further below with reference to FIGS. 11 and 12.

In FIG. 9, actuator 703 includes a retraction device, illustrated here as a spring 904, to retract or return actuator 730 to the rest position when the external force is removed or terminated. In FIG. 9, spring 904 is increasingly stretched as actuator 730 moves away from the rest position.

Figure 10:
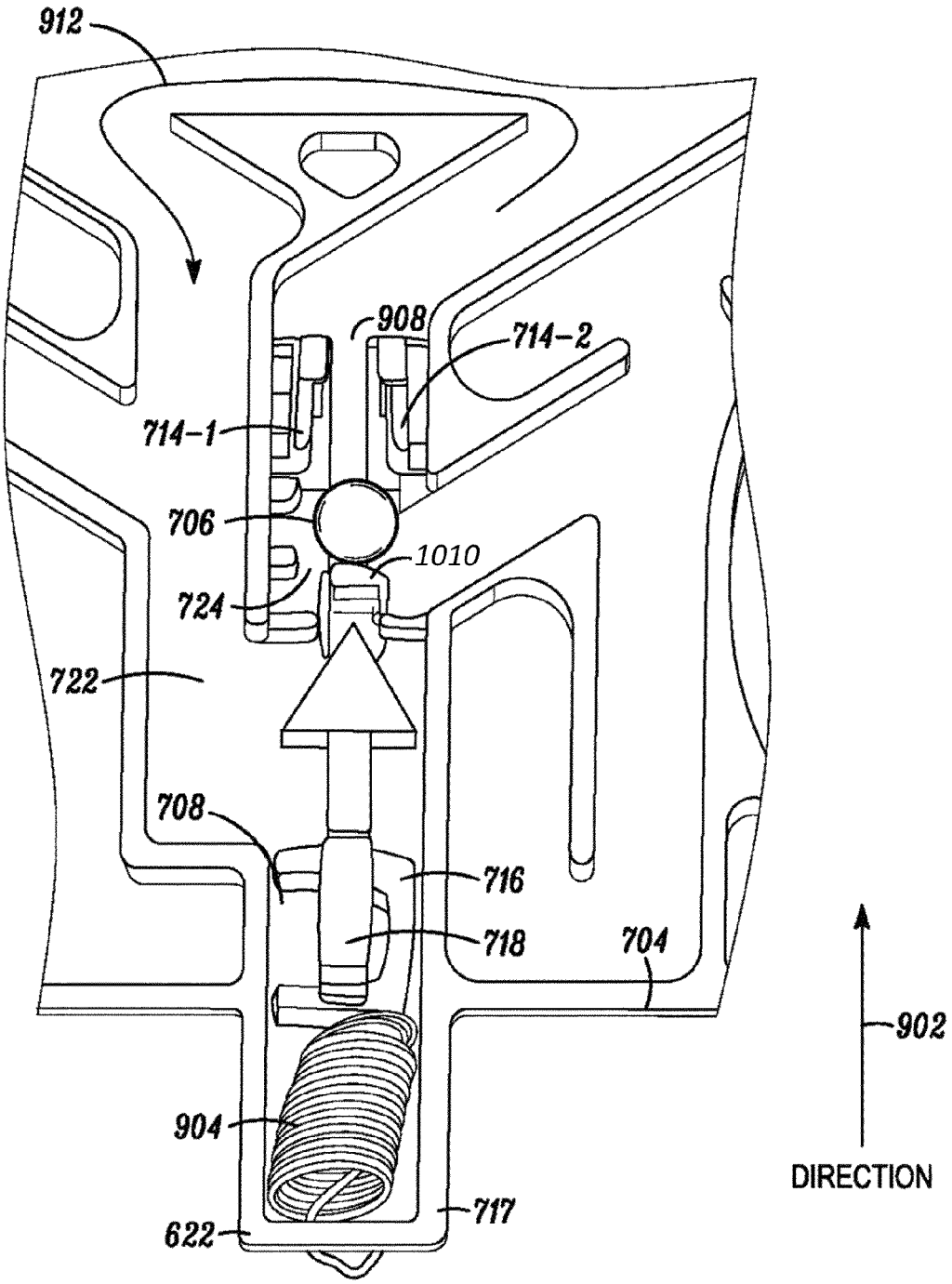
FIG. 10 is another expanded view of the portion of the first sub-assembly illustrated in FIG. 9, where the ball is in a second area of the ball passage.

FIG. 10 is another expanded view of a portion of sub-assembly 602, including a portion of actuator 730. In FIG. 10, actuator 730 is in the rest position and ball 706 is in second area 724.

Ball 706 may be moved from first area 722 to second area 724 via the labyrinth or maze ball passage, also referred to herein as completing the maze.

When ball 706 is with second area 724, an eternal force may be applied to handle 718 in direction 902 to move actuator 730 towards a second extended position, and thereafter towards a third extended position.

As actuator 730 advances toward the second extended position, a surface 1010 of body 716 contacts and applies a force to ball 706 to force ball 706 toward and between detents 714. Surface 1010 may be a concave surface, such as illustrated in FIG. 11. The concave surface may help to retain ball 706 at surface 1010 as body 716 is moved in direction 902.

As ball 706 is forced between detents 714, detents 714 move or bend away from one another to unlock or release protrusion 204 (FIGS. 2, 3, and 4). When protrusion 204 is released from detents 714, cover 102 may be opened to expose the first opening to the prize compartment to permit removal of a prize from the prize compartment.

With continued external force, actuator 730 advances toward the third extended position to move ball 706 past detents 714 into a third area 908. As ball 706 moves past, or exits detents 714, detents 714 return to their rest positions.

Surface 608 of sub-assembly 602 may have a recess or groove within area 724 to help retain and/or guide ball 706 towards, between, and/or past detents 714 as actuator 730 exerts force on ball 706. The recess or groove may be longitudinal and may be parallel with direction 902.

The second extended position or the third extended position of actuator 730 may correspond to the first extended position of actuator 730, a position between the rest position of actuator 730 and the first extended position, or a position beyond the first extended position.

Device 100 may have a first ball passage from first area 722 to second area 724, also referred to herein as a primary or maze passage, as described above. Device 100 may further have a second passage from third area 908 to area first 722, also referred to herein as a ball return passage, to permit ball 706 to return to first area 722 without having to re-trace the maze passage from second area 724 to first area 722.

When ball 706 is returned to first area 722, actuator 730 may be moved to the first extended position to permit ball 706 to enter ball cavity 708 of body 716. Actuator 730 may then be released to return to the first position to retain ball 706 within ball cavity 708 as described further above.

Example techniques to assist in moving ball 706 from ball cavity 108 into first area 722 are disclosed below with reference to FIGS. 11 and 12.

Figure 11:
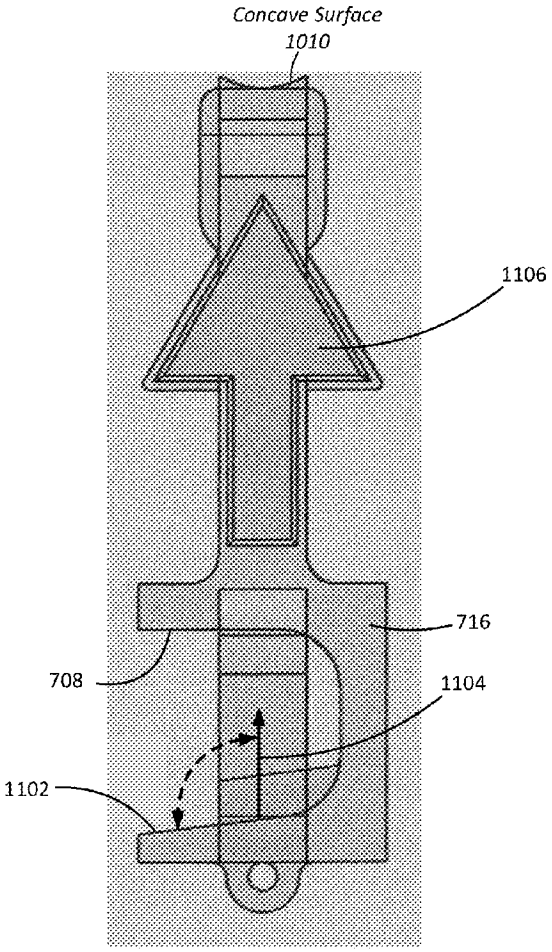
FIG. 11 is expanded view of an implementation of an actuator of FIG. 7.

FIG. 11 is expanded view of an implementation of actuator 730, where a cavity wall portion 1102 of ball cavity 708 is configured to assist ball 706 to exit ball cavity 708 as actuator 730 is moved from the first position to the first extended position. In FIG. 11, cavity wall portion 1102 is angled more than 90 degrees from a direction of travel 1104 of actuator 730. Cavity wall portion 1102 may be angled between 90 degrees and 180 degrees from direction of travel 1104.

In FIG. 11, actuator 730 includes an arrow-shaped feature 1106 that points to second area 724. Arrow-shaped feature 1106 may be colored or otherwise highlighted to identify second area 724 as a destination of ball 706.

Figure 12:
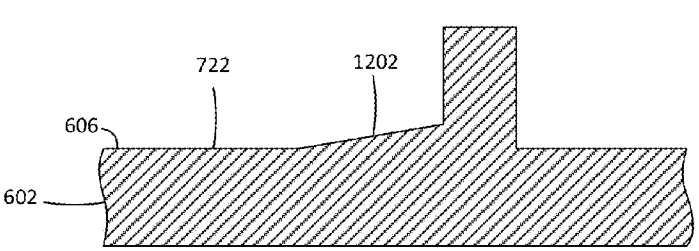
FIG. 12 is a cross-sectional side view of a portion of the first sub-assembly.

Surface 722 of sub-assembly 602 may include a ramp feature to cause ball 706 to roll out of ball cavity 708 and into first area 722, such as illustrated in FIG. 12.

FIG. 12 is a cross-sectional side view of a portion of sub-assembly 602 (view B in FIG. 9), where a portion 1202 of surface 606, within the channel of actuator 730, is ramped or angled relative to other portions of surface 606. The ramp may help to cause ball 706 to exit ball cavity 708 to area 722 as actuator 730 is moved from the first position to the first extended position.

An example implementation of second opening to a prize compartment is disclosed below with reference to FIG. 13.

Figure 13:
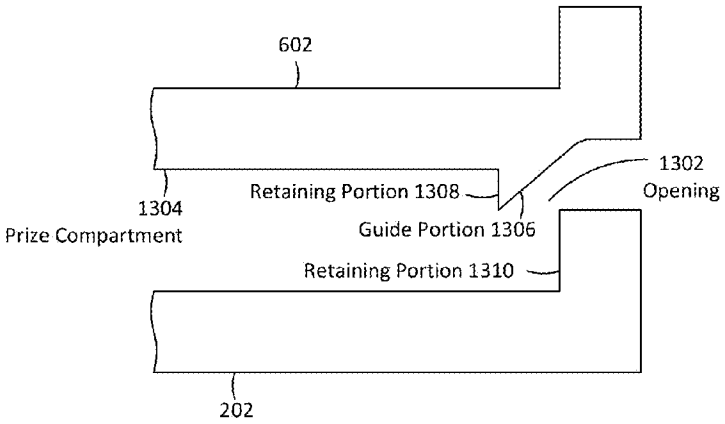
FIG. 13 is a cross-sectional side view of a portion of the device of FIG. 1 (view A of FIG. 1).

FIG. 13 is a cross-sectional side view of a portion of device 100 (view A of FIG. 1), in which first sub-assembly 602 and base 202 are configured to provide an opening 1302 to a prize compartment 1304.

In FIG. 13, first assembly 602 includes a guide portion 1306 extending therefrom to guide or re-direct a prize into prize compartment 1304, as the prize is inserted into opening 1302. First assembly 602 further includes a retaining portion 1308 extending therefrom, and base 202 includes a retaining portion 1310, together configured to inhibit removal of the prize from prize compartment 1304 through opening 1302.

Example pry-inhibitors to inhibit tampering (e.g., prying) of cover 102 are disclosed below with reference to FIGS. 14 through 17.

Figure 14:
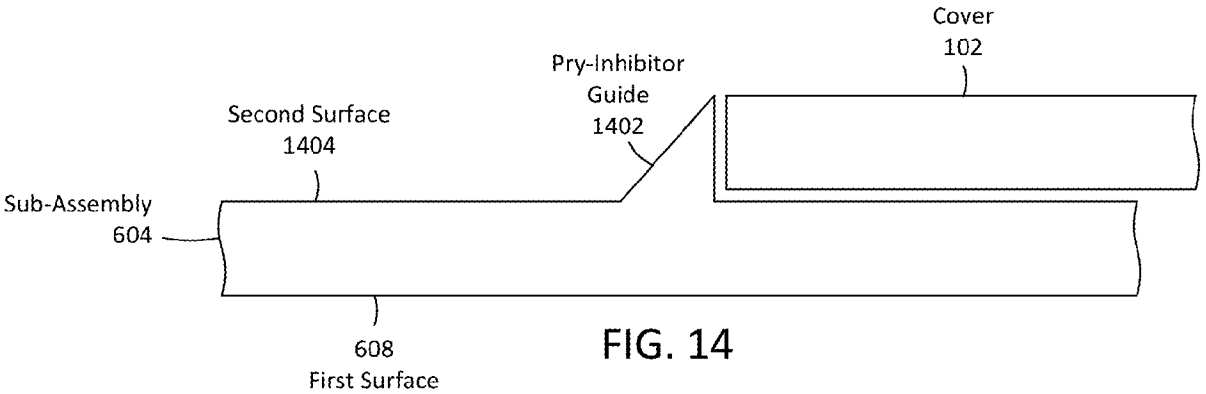
FIG. 14 is a cross-sectional side view of a portion of the second sub-assembly 604.

FIG. 14 is a cross-sectional side view of a portion of sub-assembly 604, and a portion of cover 102 in the closed position. In FIG. 14, sub-assembly 604 includes a pry-inhibitor, illustrated here as a guide 1402 extending from a second surface 1404 of sub-assembly 604 to inhibit insertion of a tool to pry cover 102 away from second surface 1404. Guide 1402 may extend along one or more edges of cover 102.

Figure 15:
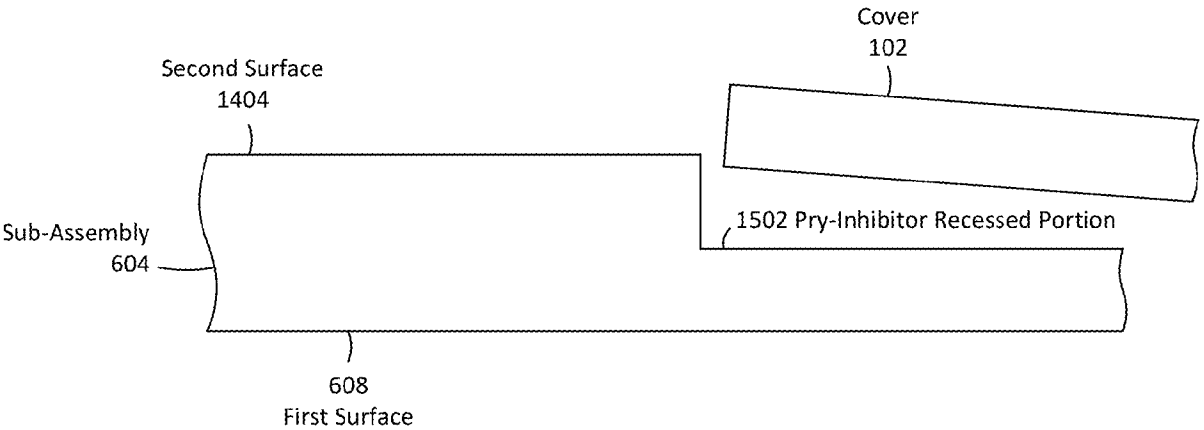
FIG. 15 is another cross-sectional side view of a portion of the second sub-assembly.

FIG. 15 is a cross-sectional side view of a portion of sub-assembly 604, and a portion of cover 102 in an open position. In FIG. 15, sub-assembly 604 includes a second surface 1502 having a pry-inhibitor, illustrated here as a recessed portion 1504, to receive cover 102 when cover 102 is moved to the closed position, and to inhibit insertion of a tool to pry cover 102 away from sub-assembly 604. Recessed portion 1502 may extend along one or more edges of cover 102.

Figure 16:
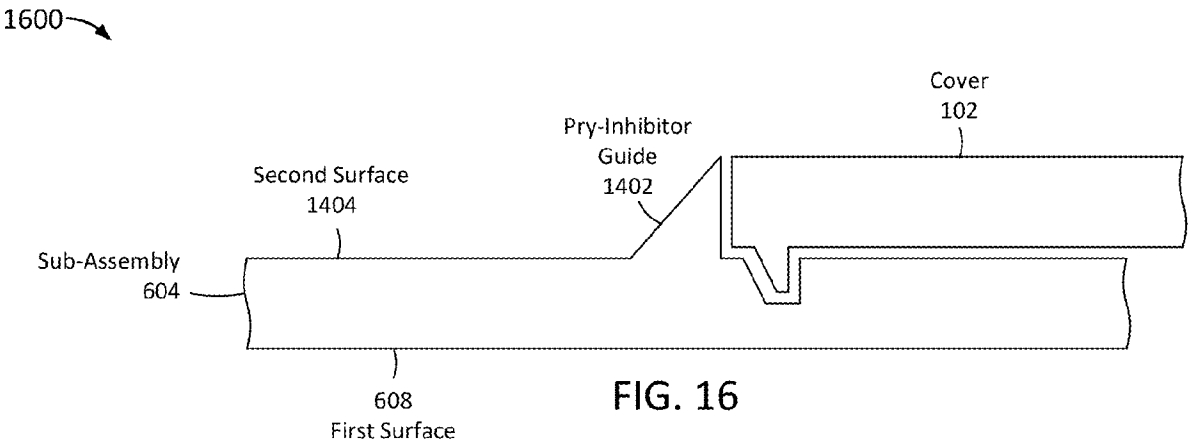
FIG. 16 is the cross-sectional side view of FIG. 14, further including a rail extending from a cover, and a housing surface having a channel to receive the rail when the cover is closed to inhibit lateral motion of the cover relative to the housing.

FIG. 16 is a cross-sectional side view of a portion of sub-assembly 604, and a portion of cover 102 in the closed position, including features described above with reference to FIG. 14, and further includes a rail 1602 extending from cover 102, and a corresponding channel 1604 in second surface 1404 of sub-assembly 604 to receive rail 1604. Rail 1602 may extend along one or more edges of cover 102, and channel 1604 may extend along a corresponding portion of second surface 1404. Rail 1602 and channel 1604 may inhibit lateral motion of cover 102 relative to sub-assembly 604, which may help to preclude forced opening of cover 102 without completion of the maze.

Figure 17:
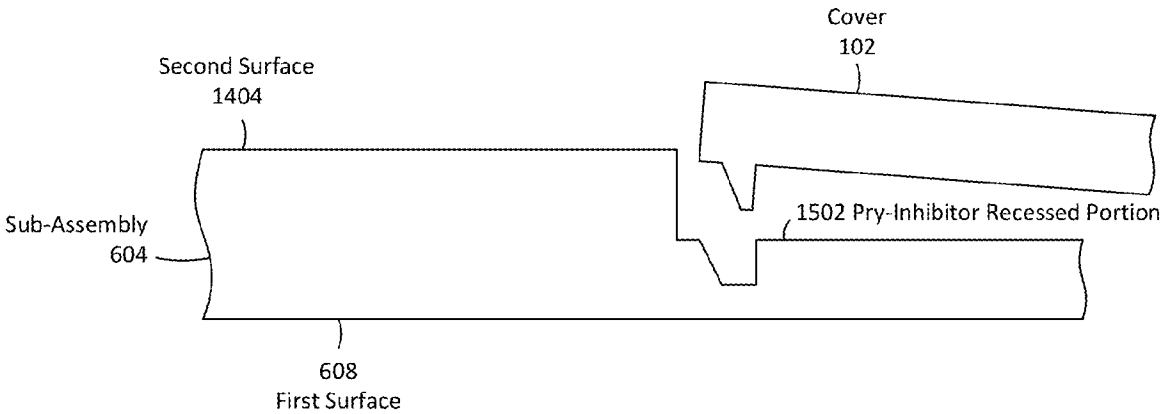
FIG. 17 is the cross-sectional side view of FIG. 15, further including a rail extending from a cover, and a housing surface having a channel to receive the rail when the cover is closed to inhibit lateral motion of the cover relative to the housing.

FIG. 17 is a cross-sectional side view of a portion of sub-assembly 604, and a portion of cover 102 in an open position, including features described above with reference to FIG. 15, and further including a rail 1702 extending from cover 102, and a corresponding channel 1704 in second surface 1404 of sub-assembly 604 to receive rail 1704. Rail 1702 may extend along one or more edges of cover 102, and channel 1704 may extend along a corresponding portion of second surface 1404. Rail 1702 and channel 1704 may inhibit lateral motion of cover 102 relative to sub-assembly 604, which may help to preclude forced opening of cover 102 without completion of the maze.

Device 100 may be configured to as a package and/or envelope, which may be presented or delivered to a recipient with a prize therein. In FIG. 2, for example, base 202 and assembly 600 have having substantially rectangular shapes, which may represent an envelope, and cover 102 has a somewhat triangular-shape, which may represent an envelope flap. Device 100 is not, however, limited to these examples.

Device 100 may be removably positioned within a container such as described below with reference to FIG. 18.

Figure 18:
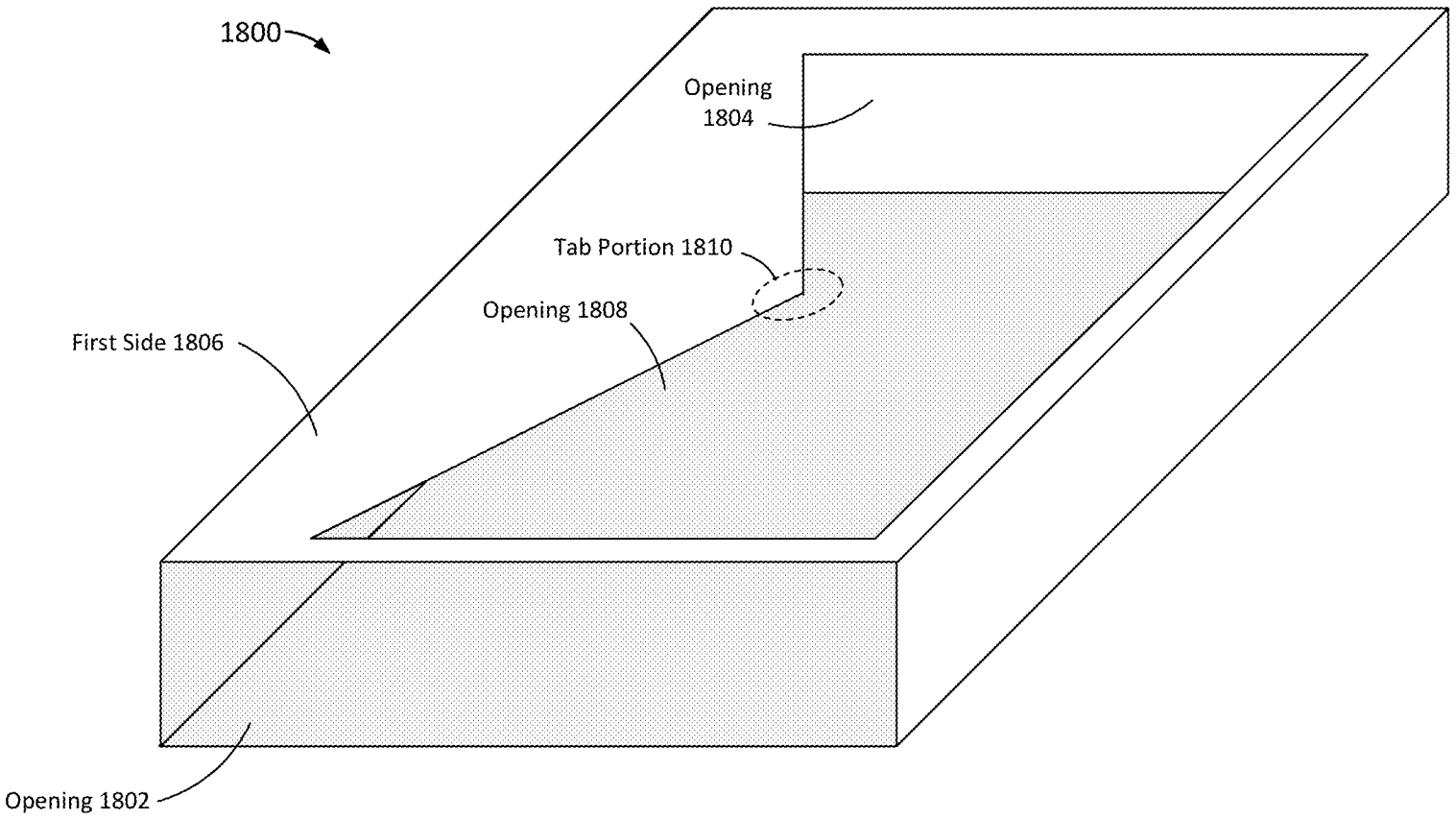
FIG. 18 is a perspective view of a container package to receive a portable game device.

FIG. 18 is a perspective view of a container 1800 to receive device 100 through an opening 1802 and/or an opening 1804 of a corresponding end of container 1800.

Container 1800 includes a first side 1806 having an opening 1808 therethrough to permit viewing of device 100.

Container 1800 may include one or more features to retain device 100 within, and centered within container 1800 during shipping and handling. For example, cover 102 (FIGS. 2, 3, 4, and 5), may include a second protrusion extending in a direction opposite to that of protrusion 204, and first side 1806 of containing 1800 may include tab portion 1810 to receive or hold the second protrusion of cover 102. Tab portion 1810 may include an opening or slot through first side 1806 to receive the second protrusion of cover 102.

The second protrusion may be positioned over second area 724 (FIG. 7), and may include a "bulls-eye" target and/or other visual indicator(s) to identify second area 724 as a target destination of ball 706.

An example of tab portion 1800 is provided below with reference to FIG. 19. An example second protrusion is provided below with reference to FIG. 20.

Figure 19:
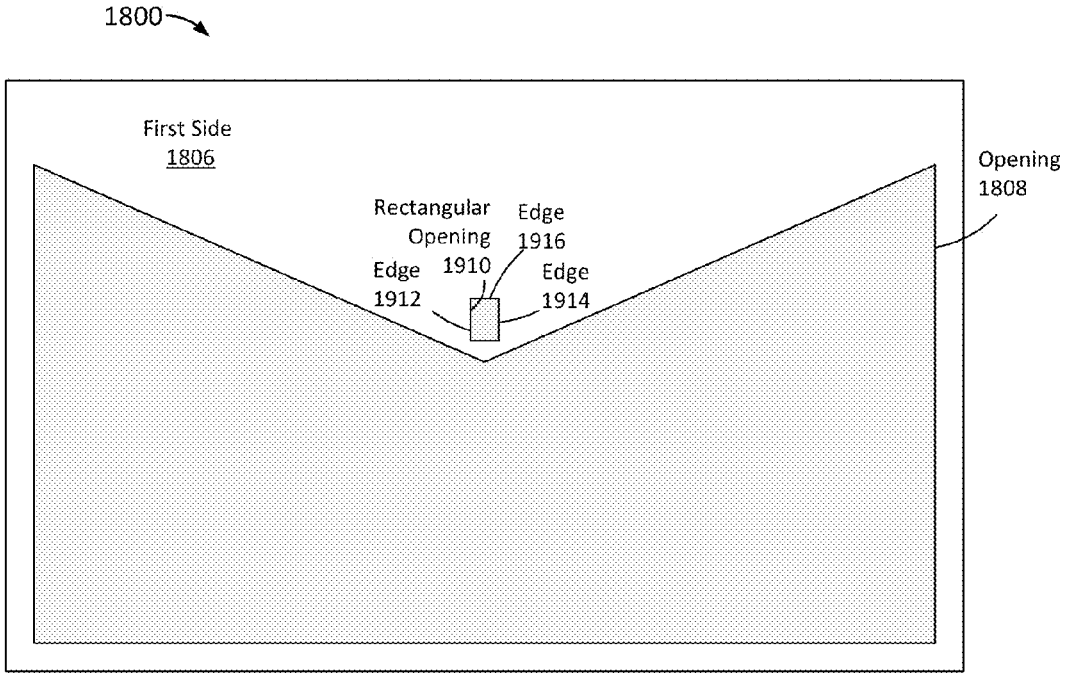
FIG. 19 is another view of the container package of FIG. 18.

FIG. 19 is a view of a container 1800, in which a rectangular opening 1910 is formed through first side 1806. Rectangular opening 1910 may represent an example implementation of tab portion 1810 in FIG. 18.

Figure 20:
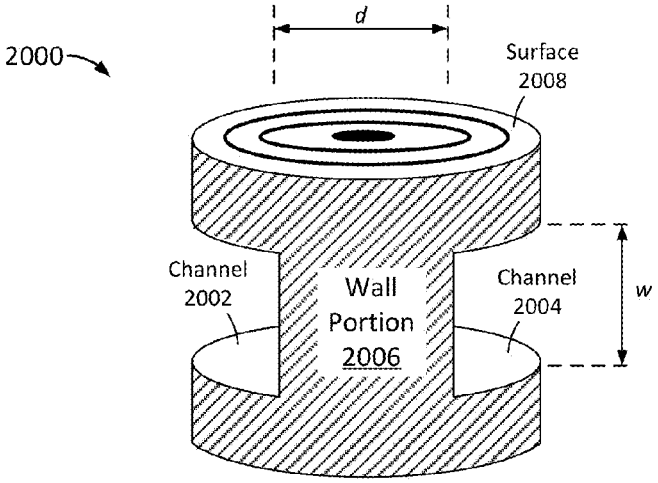
FIG. 20 is a perspective view of a protrusion, which may extend from a game device to engage a tab portion of the container package of FIGS. 18 and 19 to secure the game device within the container package.

FIG. 20 is a perspective view of a protrusion 2000, which may extend from enclosure portion 212 of cover 102 (FIG. 2), in a direction opposite to that of protrusion 204. In the example of FIG. 20, protrusion 2000 is illustrated as a cylinder having channels 2002 and 2004 to receive respective edges 1912 and 1914 of rectangular opening 1910 in FIG. 19. A width w of channels 2002 and 2004 may be at least equal to a thickness of first side 1806 of container 1800. A thickness or depth d of a wall portion 2006 between channels 2002 and 2004 may be approximately equal to a length of an edge 1916 of opening 1910 in FIG. 19.

When edges 1912 and 1914 are positioned within channels 2002 and 2004, device 100 may be securely retained and centered within container 1800.

Protrusion 2000 may be positioned over second area 724 (FIG. 7), and may include a bulls-eye target on a surface 2008, and/or other visual indicator(s) to identify or highlight area 724 as a target destination of ball 706.

Device 100, or portions thereof, may be manufactured or fabricated with one or more of a variety of natural and/or manufactured materials including, without limitation, plastic, acrylic, glass, fiberglass, wood, metal, and combinations thereof.

Device 100, or portions thereof, may be manufactured or fabricated with an injection molding process.

Device 100, or portions thereof, may be manufactured or fabricated with a visible-light-transmissive (i.e., optically transparent or see-through) material to permit viewing of the ball passage within device 100.

Systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What is claimed is:

1. An apparatus, comprising a portable game device, including:

a housing having a game ball passage and a prize compartment therein, and a first opening to the prize compartment through a first surface of the housing;

a moveable cover to enclose the first opening to the prize compartment when in a closed position and to expose the first opening to the prize compartment when in an open position;

a lock mechanism to releasably retain the cover in the closed position; and a mechanically operable actuator, movable between a rest position and a first position;

wherein the actuator has a ball cavity therein and an opening to the ball cavity through a surface of the actuator to provide a ball passage between the ball cavity and a first portion of game ball passage when the actuator is in the first position; and wherein the actuator is configured to retain a ball within the ball cavity when the actuator is returned to the rest position with the ball in the ball cavity; and wherein the actuator is controllable to move the ball from a second portion of the game ball passage to the lock mechanism, and to move the ball from the second position to unlock the lock mechanism with the ball.

2. The apparatus of claim 1, wherein the moveable cover is hingedly connected to the housing.

3. The apparatus of claim 1, wherein the actuator includes a convex surface to contact the ball when the actuator moves the ball from the second portion of the game ball passage to the lock mechanism.

4. The apparatus of claim 1, wherein a surface within the housing includes a channel to guide the ball as the actuator moves the ball from the second portion of the game ball passage to the lock mechanism.

5. The apparatus of claim 1, wherein the housing and the cover are configured to inhibit prying the cover away from the housing when the cover is in the closed position.

6. The apparatus of claim 5, wherein the housing includes a guide portion extending from a surface of the housing to inhibit insertion of a pry tool under the cover when the cover is in the closed position.

7. The apparatus of claim 5, wherein the housing includes a recessed portion to receive the cover and inhibit insertion of a pry tool under the cover when the cover is in the closed position.

8. The apparatus of claim 1, wherein the cover includes a rail portion extending from a surface thereof, and wherein the housing includes a channel to receive the rail when the cover is in the closed position, and wherein the rail and channel are configured to inhibit movement of the cover relative to the housing.

9. The apparatus of claim 1, wherein the game device is configured as a letter envelope to hold a one or more of paper currency and a financial transaction card within the prize compartment, wherein the housing has rectangular box shape (rectangular cuboid), and the cover is configured as a hinged envelope flap.

10. The apparatus of claim 1, wherein the housing has a second opening to the prize compartment through a second surface of the housing to permit insertion of a prize into the prize compartment, and wherein the second opening includes:

a retention portion to inhibit removal of the prize from the prize compartment through the second opening; and a guide portion to guide the prize past the retention portion as the prize is inserted into the prize compartment through the second opening.

11. The apparatus of claim 1, wherein a wall of the ball cavity is angled between 90 degrees and 180 degrees relative to a direction of motion of the actuator to assist the ball to exit the ball cavity to the first portion of the game ball passage as the actuator is moved from the rest position to the first position.

12. The apparatus of claim 1, wherein a surface within the housing has a ramp portion under a travel path of the actuator to assist the ball to exit the ball cavity to the first portion of the game ball passage as the actuator is moved from the rest position to the first position.

13. The apparatus of claim 1, further including:

a container package having a cavity to hold the game device, wherein the container package has first and second open ends, each dimensioned to receive the game device;

wherein the container package has an opening through a side of the container package to expose a portion of the housing; and wherein the side of the container package includes a tab portion configured to secure the housing within the container package cavity.

14. The apparatus of claim 13, wherein:

the tab portion includes a rectangular opening through the side of the container package; and the game device includes a cylindrical protrusion extending from a surface thereof, wherein the cylindrical protrusion has first and second opposing channels to receive opposing edges of the rectangular opening when the cylindrical protrusion is inserted into the rectangular opening.

15. The apparatus of claim 14, wherein the cylindrical protrusion is positioned above a target destination of the game ball passage and has visual markings to identify the target destination.

16. The apparatus of claim 1, wherein the game ball passage includes a passage portion having a sequence of parallel walls, each wall having an opening to permit the ball to pass therethrough, wherein the openings of adjacent walls are staggered relative to one another.

17. The apparatus of claim 1, wherein the housing includes a rotatable device within the game ball passage, and wherein the rotatable device includes radially extending paddles to direct the ball in a circular fashion.

18. The apparatus of claim 1, wherein the game ball passage includes one or more of a labyrinth portion and a maze portion.

19. The apparatus of claim 1, wherein:

the housing includes a return ball passage between the lock mechanism and the first portion of the game ball passage;

the lock mechanism includes opposing flexible detents; and the actuator is configured to move the ball between to detents to force the detents away from one another to unlock the lock mechanism, and to move the ball past the detents to the return ball passage.

* * * * *